US005225302A

United States Patent [19]

Isoda et al.

[11] Patent Number: 5,225,302

[45] Date of Patent: Jul. 6, 1993

[54] TWO-COMPONENT DRY TYPE DEVELOPER FOR DEVELOPING LATENT ELECTROSTATIC IMAGES

[75] Inventors: Tetsuo Isoda; Mitsuo Aoki; Takahisa Kato, all of Numazu, Japan

[73] Assignee: Ricoh Company, Ltd., Tokyo, Japan

[21] Appl. No.: 636,909

[22] Filed: Jan. 2, 1991

[30] Foreign Application Priority Data

Jan. 23, 1990 [JP] Japan ..... 2-14658

[51] Int. Cl.[5] ..... G03G 9/00

[52] U.S. Cl. ..... 430/106.6; 430/109; 430/122; 430/137

[58] Field of Search ..... 430/106.6, 122, 109, 430/137

[56] References Cited

U.S. PATENT DOCUMENTS 4,963,454 10/1990 Yano et al. ..... 430/106.6

5,053,305 10/1991 Aoki et al. ..... 430/106.6

*Primary Examiner*—Marion E. McCamish

*Assistant Examiner*—S. Rosasco

*Attorney, Agent, or Firm*—Cooper & Dunham

[57] ABSTRACT

A two-component dry type developer for developing latent electrostatic images comprises (i) toner particles with an average particle diameter of 14 μm or less and (ii) carrier particles with an average particle diameter of 70 μm or less, with the ratio of the average particle diameter of the toner particles to the average particle diameter of the carrier particles being 1/5 or less, with a dynamic resistance of $1.0\times10^8\ \Omega$ or less, and the specific triboelectric charge quantity generated between the toner particles and the carrier particles per unit weight of the toner particles is 25 μC/g or more.

22 Claims, 2 Drawing Sheets

TWO-COMPONENT DRY TYPE DEVELOPER FOR DEVELOPING LATENT ELECTROSTATIC IMAGES

BACKGROUND OF THE INVENTION

1. Field of the Invention

The present invention relates to a two-component dry type developer for developing latent electrostatic images formed on a latent-electrostatic-image-bearing member in the fields of electrophotography, electrostatic recording and electrostatic printing.

2. Discussion of Background

Image formation processes employed in the field of electrophotography are widely known. Generally, a photoconductor is charged by corona charge, and exposed to light images corresponding to original images. The portions exposed to the light images become electroconductive, so that electric charges dissipate therefrom. As a result, the unexposed portions remain in the form of latent electrostatic images on the photoconductor. When a toner which is charged to the opposite polarity to that of the latent electrostatic images formed on the photoconductor are brought near the latent electrostatic images, the toner is electrostatically attracted to the latent electrostatic images, so that the latent electrostatic images are developed to visible toner images. The visible toner images are then transferred to an image-receiving sheet, and fixed thereon.

To develop latent electrostatic images, a one-component type developer comprising a toner component and a two-component type developer comprising a toner component and a carrier component are used.

When latent electrostatic images are developed by the two-component type developer, toner particles with insulating properties are triboelectrically charged to a predetermined polarity by bringing the toner particles into contact with magnetic carrier particles. At the same time, a magnetic brush is formed by the triboelectrically charged toner particles and the carrier particles. The latent electrostatic images are developed into visible toner images with the toner particles contained in the magnetic brush by bringing the magnetic brush into slide contact with the latent electrostatic images formed on the photoconductor.

With the two-component type developer, it is preferable that the materials for the carrier particles and for the toner particles be appropriately selected, with the triboelectric series thereof taken into consideration. When the material for the carrier is too separated from the material for the toner in the triboelectric series, the attraction between the toner particle and the carrier particle is so strong that the attraction between the toner particles and the carrier particles exceeds the attraction between the toner particles and the latent electrostatic images to be developed. The result is that the obtained image density is low.

The image density can be increased by increasing the toner concentration in the developer. However, when the toner concentration is excessively increased, the toner particles tend to stick together and to be deposited in non-image areas on the photoconductor.

The image density may also be increased by increasing the electric charge applied to the photoconductor to maintain the potential thereof at a high level. In this case, however, a large quantity of electric power is consumed to maintain the high potential of the photoconductor. Moreover, in the case where the potential of the photoconductor is high, even the carrier particles in the developer are deposited on the photoconductor. When the carrier particles are deposited on the surface of the photoconductor, the carrier particles tend to be transferred to a transfer sheet, so that the so-called "carry-over" of carrier takes place, and the surface of the photoconductor is scratched by the carrier particles in the course of the image transfer operation and cleaning operation.

It is most desirable that the triboelectric properties of the surface of the carrier be controlled, while maintaining the desirable physical properties of the toner and the carrier, when the developer is used in practice. One of the most significant factors which affect the stability of the triboelectric properties of the carrier is whether or not toner particles easily adhere to the carrier particles. Namely, when the developer is used in repetition, the toner particles held on the carrier particles are fused with the surface of the carrier particles or brought into pressure contact with the toner particles, by the collision between the carrier particles and various mechanical parts in a development unit. As the fused toner particles are accumulated on the surface of the carrier particles, the triboelectric chargeability of the carrier is changed, and the toner-holding capability of the carrier particle decreases so that the development performance of the developer eventually decreases.

In U.S. Pat. No. 3,942,979, there is disclosed a two-component type developer Which comprises (i) carrier particles with a specific surface area of at least about 150 $cm^2/g$ and (ii) a toner comprising in terms of numerical percentage about 30% or less of toner particles with an average particle diameter of about 5 μm or less, about 25% of toner particles with an average particle diameter of about 8 to 12 μm, and 5% or less of toner particles with an average particle diameter of about 20 μm or more.

Generally in cascade development, carrier particles with an average particle diameter of about 30 to 1,000 μm are used, while in magnetic brush development, carrier particles with an average particle diameter of about 30 to 250 μm are used.

Commercially available developers for magnetic brush development comprise carrier particles with an average particle diameter of about 100 to 200 μm and toner particles with an average particle diameter of 1 to 30 μm. These developers, however, do not meet the requirements that images be produced with high image quality for an extended period of time.

To improve the image quality of copied images, it is important that the specific triboelectric charge quantity of the toner and carrier be within an optimal range. As for a two-component type developer, the specific triboelectric charge quantity is usually measured by a blow-off method, which measures the quantity of electric charge generated between the toner particles and the carrier particles per unit weight of the toner particles. Hereinafter, the specific triboelectric charge is simply referred to as the specific triboelectric charge of toner particles. The higher the value, the greater the quantity of the triboelectric charge generated between the toner particles and the carrier particles. When the value of the specific triboelectric charge quantity of the carrier is high, an electric field with high intensity is required to develop latent electrostatic images formed on the photoconductor with the toner particles, because the toner particles have to be separated from the carrier particles with large force for developing latent electrostatic images. The force required for separating the toner particles from the carrier particles is determined by the intensity of the electric field between the photoconductor and a development sleeve for supporting the developer thereon, which is directed toward the photoconductor.

As previously mentioned, when the specific triboelectric charge quantity of the toner exceeds an optimal level, the toner cannot be sufficiently transported onto the photoconductor even if the intensity of the electric field between the photoconductor and the development sleeve is set at a normal value. The result is that images obtained have low image density. On the other hand, when the specific triboelectric charge quantity of the toner is lower than the optimal level, the attraction force between the carrier particle and the toner particle is so weak that the toner particles are easily separated from the carrier particles and transported onto the photoconductor, so that images with high image density can be obtained. However the toner particles are easily scattered even by an air stream caused by the rotation of the development sleeve. The result is that the scattered toner particles stain the inner parts of the development unit.

Furthermore, such toner particles are deposited not only on image areas, but also on non-image areas of the photoconductor, so that the so-called fogging occurs in the images obtained. As mentioned previously, a developer comprising toner particles and carrier particles, with a low triboelectric charge quantity, however, has an advantage that high image density can be obtained. This is because a large amount of the toner particles can be transferred to the photoconductor even when the intensity of the electric field between the photoconductor and the development sleeve is not high.

More specifically, when the triboelectric charge quantity of the toner is 10 $\mu$C/g or less, the toner particles are considerably scattered in the development unit although images with high density can be obtained. In contrast to this, a developer which comprises toner particles and carrier particles with a specific triboelectric charge quantity of 25 $\mu$C/g or more is not capable of producing images with high image density although the scattering of the toner particles can be avoided. With the above-mentioned advantages and disadvantages taken into consideration, most of the commercially available developers have a specific triboelectric charge quantity ranging from 10 or more to less than 25 $\mu$C/g. However, it is extremely difficult to maintain the specific triboelectric charge quantity in the above-mentioned range while in use. In particular, when the developer is repeatedly used for copying operation, the toner particles are fused to the surface of the carrier particle. As a result, the triboelectric effect between the toner particle and the carrier particle declines, so that the charge quantity of the toner is decreased and the scattering of the toner particles tends to take place.

SUMMARY OF THE INVENTION

Accordingly, a first object of the present invention is to provide a two-component dry type developer comprising toner particles and carrier particles, free from the shortcomings of conventional two-component dry type developers, capable of producing images with high image density, with sufficiently high specific triboelectric charge quantity for preventing the toner particles from scattering while in use.

A second object of the present invention is to provide a two-component dry type developer having stable electrophotographic characteristics.

A third object of the present invention is to provide a two-component dry type developer having a prolonged life.

A fourth object of the present invention is to provide a two-component dry type developer in which the toner particles are not fused to the surface of the carrier particles.

The above-mentioned objects of the present invention can be achieved by a two-component dry type developer for developing latent electrostatic images comprising (i) toner particles with an average particle diameter of 14 $\mu$m or less and (ii) carrier particles with an average particle diameter of 70 $\mu$m or less, with the ratio of the average particle diameter of the toner particles to the average particle diameter of the carrier particles being 1/5 or less, with a dynamic resistance of $1.0\times10^8\ \Omega$ or less, and the specific triboelectric charge quantity generated between the toner particles and the carrier particles per unit weight of the toner particles being 25 $\mu$C/g or more.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
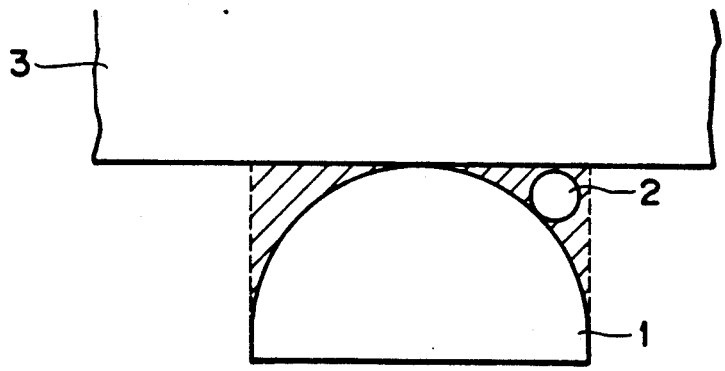
FIG. 1 is a schematic view in explanation of the relationship between a toner particle diameter and a carrier particle diameter.

When the toner particles of a two-component dry type developer are triboelectrically charged, it is important that the toner particles are effectively brought into contact with carrier particles. On the surface of each carrier particle, there are portions where the toner particles are deposited, and portions where the toner particles are not deposited. During the course of a repeated copy making process by use of a copying apparatus, toner particles deposited on the surface of the carrier particle are separated therefrom and transported onto the surface of a photoconductor and used for developing the latent electrostatic images formed on the photoconductor into visible toner images. New toner particles are then replenished to a development unit of the copying apparatus in the course of the above-mentioned copy making cycle. The toner particles thus replenished can be triboelectrically charged by the contact with the carrier particles in the surface areas where no toner particles are deposited. The charge quantity gained by one toner particle by one collision of the toner particle with the carrier particle is dependent on the chemical properties of both the toner particle and the carrier particle.

Usually toner particles comprise a binder resin and a coloring agent such as carbon. The toner particles may further contain a charge controlling agent (CCA) and an additive to improve the fluidity of the toner particles, such as titanium oxide and silica. One toner particle is therefore composed of various components, so that the triboelectric charging property of the toner particles by the contact with the carrier particles is delicately and complicatedly influenced by the chemical composition of the toner particle. Furthermore, the distribution of the charge in a single toner particle, per se, is not uniform. However, the behavior of a toner particle in an electric field is determined by the total charge quantity of the toner particle.

The specific triboelectric charge quantity (Q/M), measured by the blow-off method, is not based on the charge quantity of each toner particle, but on the average charge quantity of the Whole toner particles.

When the average charge quantity of the toner is low, a measurement by use of a charge quantity distribution measuring apparatus indicates that some toner particles are charged to one polarity and the other toner particles are charged to an opposite polarity.

Usually, the toner particles and carrier particles are charged to opposite polarities by triboelectric charging. Therefore, the Coulomb's electrostatic attraction is generated between the toner particles and the carrier particles. However, when toner particles are charged to different polarities, as previously mentioned, some of them have the same polarity as that of the carrier particles. Such toner particles and the carrier particles repel each other. More specifically, these toner particles easily separate from the carrier particles and tend to scatter. The scattered toner particles cling to the non-image areas on the photoconductor, which induces the deposition of the toner particles on the background of an image receiving sheet.

By setting an average specific charge quantity of the toner at a high value, the number of the toner particles with an opposite polarity to a predetermined polarity can be decreased and the scattering of these toner particles can be avoided. However, if the chemical properties of both the carrier particles and the toner particles are changed so as to move a larger quantity of electric charge between the toner particles and the carrier particles by one collision or contact between the toner particles and the carrier particles, toner particles with the opposite polarity can be reduced.

In general, when the specific charge quantity of the toner is set high, the Coulomb force between the toner particles and the carrier particles becomes strong, so that the toner particles are not easily transferred onto the photoconductor. This decreases the development efficiency.

The present invention is directed toward the attainment of the improvement of the development efficiency with the above-mentioned specific triboelectric charge quantity of the toner being maintained high.

The force required for separating a toner particle from a carrier particle is determined by i) the intensity of the electric field applied between a photoconductor and a development sleeve for holding the toner particles and (ii) the charge quantity of the toner particle. On the other hand, the toner particle is attracted toward the carrier particle by the Coulomb force between the two particles, and the Coulomb force is influenced by the charge retainability of the carrier.

When the toner particle is separated from the carrier particle, a counter charge corresponding to the electric charge held by the toner particle tends to remain as a residual counter charge on the surface of the carrier particle. The residual counter charge thus generated is closely related to the dynamic resistance of the carrier particle. Immediately after the toner particle is separated from the carrier particle, an electric charge with an opposite polarity to that of the toner particle generates in a moment. The counter charge thus generated on the carrier particle further enhances the attraction between the carrier particle and the toner particles which have been attached to the surface of the carrier particle.

The inventors of the present invention have discovered that the aforementioned counter charge generated immediately after the toner particle is separated from the carrier particle rapidly attenuates in the case where the dynamic resistance of the carrier particle, which will be described later, is $1.0\times10^8\ \Omega$ or less. In other words, when the dynamic resistance of the carrier particle is $1.0\times10^8\ \Omega$ or less, the counter charge scarcely remains on the surface of the carrier particle, so that the attraction of the carrier particle for the toner particle becomes weak. This makes it possible for the toner particles to travel onto the photoconductor and to produce images with high image density even though the specific triboelectric charge quantity of the toner particle is high.

Thus the carrier particles of the two-component developer according to the present invention have a dynamic resistance of $1.0\times10^8\ \Omega$ or less.

In addition to the above, the toner particles of the two-component developer according to the present invention have a volume diameter of 14 μm or less, and the carrier particle have an average particle diameter of 70 μm or less, with the ratio of the average particle diameter of the toner particle to that of the carrier particle being 1/5 or less, whereby the development efficiency is improved. Here the average particle diameter means a volume mean diameter.

With reference to FIG. 1, the improvement of the development efficiency will now be explained from the viewpoint of the relationship between the toner particle diameter and the carrier particle diameter.

In the figure, reference numeral 1 indicates a carrier particle; reference numeral 2, a toner particle; and reference numeral 3, a photoconductor.

When the carrier particle 1 is brought into contact with the photoconductor 3 as shown in FIG. 1, of the toner particles held by the carrier particle 1, those present in the shaded region contribute most to the development of the latent electrostatic images formed on the photoconductor 3.

The maximum particle diameter of the toner particle which can exist in this shaded region is "$3-2\sqrt{2}$" when the diameter of the carrier particle is "1". The ratio of the diameter of the toner particle diameter to that of the carrier particle diameter is about 1/5.

In the two-component type developer, the carrier particles can constitute a magnetic brush and perform a function of transporting the toner particles onto the photoconductor.

As is apparent from FIG. 1, of the toner particles attached to the carrier particles, those attached to the upper half surface of the carrier particle are most effectively used for development of the latent electrostatic images formed on the photoconductor. When the particle diameter of the toner particle is too large, the number of toner particles which can be attached to the upper half surface of the carrier particle is decreased. This decreases the development efficiency. The smaller the particle diameter of the carrier particle, the nearer to the photoconductor the carrier particles can be present, and therefore, the greater the development performance. However, when the carrier particle diameter is decreased, the particle diameter of the toner also must be decreased. Otherwise, the development performance could not be increased.

Conventionally, commercially available and most widely employed two-component type developers comprise carrier particles with a particle diameter of 100 to 200 μm and toner particles with a specific triboelectric charge quantity of 10 or more to less than 25 μC/g. However, it is preferable that the specific triboelectric charge quantity of the toner particles be 25 μC/g or more to prevent the toner particles from scattering while in use. When the specific triboelectric charge quantity of the toner particles is 25 μC/g or more, it is preferable that the dynamic resistance of the carrier particles be $1.0\times10^8$ Ω or less and the average particle diameter of the carrier particles be 70 μm or less. Such a developer can yield images with sufficiently high image density even when the potential difference between the photoconductor and the development sleeve is 400 V.

For the carrier particle with the dynamic resistance of $1.0\times10^8$ Ω or less for use in the present invention, magnetic core materials comprising a magnetic material such as ferrite, iron powder and magnetite can be used in the form of particles without any coating thereon. Alternatively, the above-mentioned magnetic core materials may be coated with a resin. When the magnetic core materials are used as carrier particles without coating thereon, the durability is slightly degraded. This is because the toner particles are easily fused to the surface of such carrier particles, so that the so-called "spent phenomenon" takes place on the surface of the carrier particles. If this spent phenomenon takes place, the dynamic resistance will increase and eventually exceed $1.0\times10^8$ Ω, although the initial dynamic resistance is $1.0\times10^8$ Ω or less, due to the sticking of the fuse toner particles to the carrier particles.

To prevent the spent phenomenon, it is preferable that the magnetic core particles be coated with a resin. However, resins which are usually employed for such coating have high resistivities. Therefore, the resistivity of the carrier particles increases when such resins are coated on the magnetic core particles.

In order to increase the resistivity of the carrier particles even when the aforementioned coating is made, it is preferable that an electroconductive material be dispersed in the aforementioned resin layer. Such carrier particles can be prepared by coating magnetic core particles with an electroconductive-material-dispersed-resin. Alternatively, finely-divided particles of the above-mentioned electroconductive material are dispersed in binder type carrier particles in which magnetic particles are dispersed in a binder resin.

As organic electroconductive materials for use in the carrier particles, carbon blacks such as furnace black, acetylene black and channel black can be used.

Examples of an inorganic electroconductive material for use in the present invention include borides, carbides, nitrides, oxides and silicides.

Specific examples of the borides are chromium boride, hafnium boride, molybdenum boride, niobium boride, tantalum boride, titanium boride and zirconium boride.

Specific examples of the carbides are boron carbide, hafnium carbide, molybdenum carbide, niobium carbide, silicon carbide, thallium carbide, titanium carbide, uranium carbide, vanadium carbide, tungsten carbide and zirconium carbide.

Specific examples of the nitrides are boron nitride, niobium nitride, thallium nitride, titanium nitride, vanadium nitride and zirconium nitride.

Specific examples of the oxides are chromium oxide, lead oxide, tin oxide, vanadium oxide, molybdenum oxide, bismuth oxide, iron oxide ($Fe_3O_4$), niobium oxide, osmium oxide, platinum oxide, rhenium oxide, ruthenium oxide, titanium oxide and tungsten oxide.

Specific examples of the silicides are molybdenum silicide, niobium silicide, thallium silicide, titanium silicide, vanadium silicide and tungsten silicide.

It is preferable that the particle diameter of the above finely-divided electroconductive particles be 5 μm or less, and more preferably 0.5 μm or less.

Examples of the magnetic core material for the carrier particles used in the present invention are finely-divided particles of alloys or compounds comprising a ferromagnetic element, such as iron including ferrite and magnetite, cobalt and nickel; finely-divided particles of Heusler's alloys comprising manganese and copper, such as manganese-copper-aluminum and manganese-copper-tin, which alloys do not contain ferromagnetic elements, but are converted to ferromagnetic alloys when treated by an appropriate heat treatment; and finely-divided particles of chromium dioxide.

The carrier particles for use in the present invention can be prepared by conventional methods, such as coating and spray drying. More specifically, an electroconductive material is dispersed in a solution of a thermofusible resin, and the thus obtained coating solution is coated on a magnetic core material by fluidized bed coating. Alternatively, a mixture of a thermofusible resin, a magnetic core material and an electroconductive material is kneaded under application of heat, followed by pulverizing and sphering.

Examples of resins for use in the carrier particle of the present invention are acrylic resin, methacrylic resin, polyester resin, polystyrene, polyethylene, polypropylene, polyvinylidene fluoride, polyvinylidene chloride, polyvinyl chloride, ethylene - vinyl acetate copolymer, styrene - acrylate copolymer, styrene - methacrylate copolymer, styrene - butadiene copolymer, styrene - vinylidene chloride copolymer, styrene - acrylonitrile copolymer, epoxy resin, modified rosin, polyethylene wax, polycarbonate resin and silicone resin. These resins can be used alone or in combination.

The dynamic resistance of the carrier for use in the present invention is $1.0\times10^8$ Ω or less. The measuring method of the carrier dynamic resistance will now be explained with reference to FIGS. 2 and 3.

Figure 2:
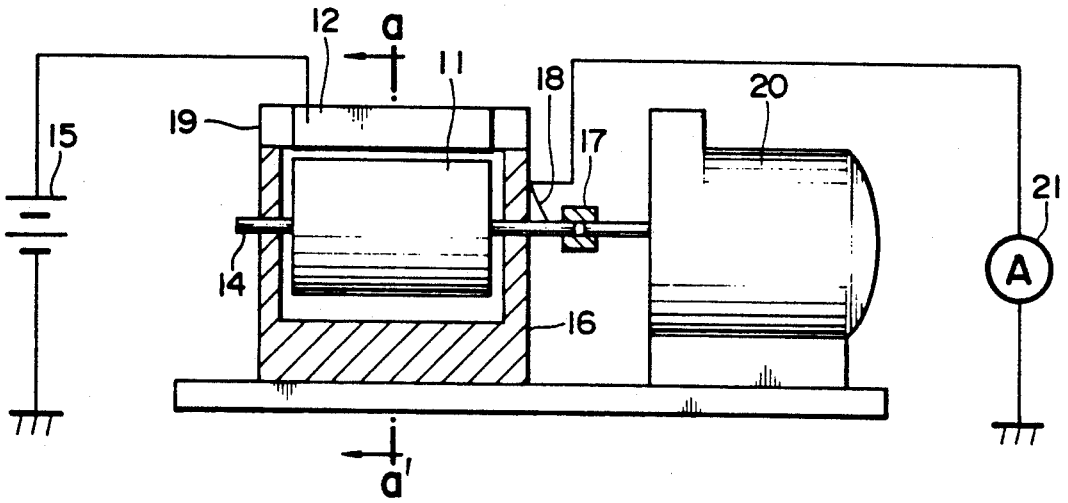
FIG. 2 is a schematic cross-sectional view of an apparatus for measuring the dynamic resistance of a carrier for use in the present invention.
Figure 3:
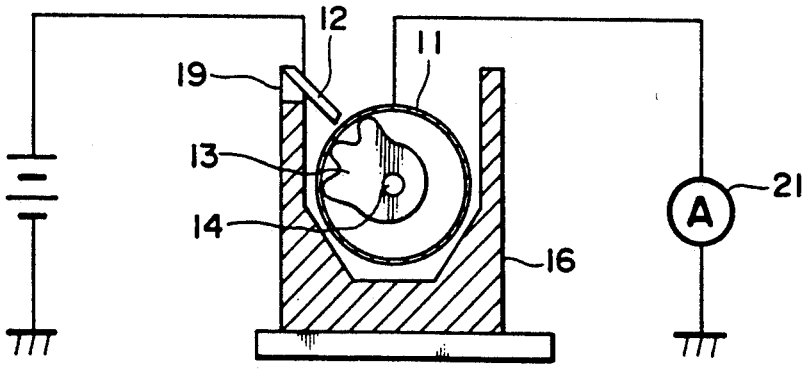
FIG. 3 is a schematic cross-sectional view taken on line a—a' in FIG. 2.

FIG. 2 is a schematic cross-sectional view of a dynamic resistance measuring apparatus for use in the present invention. FIG. 3 is a schematic cross-sectional view taken on line a—a' in FIG. 2.

In FIGS. 2 and 3, a main-pole-angle-variable magnet 13 is incorporated in a non-magnetic electroconductive cylindrical sleeve 11. The cylindrical sleeve 11 is rotatably supported by a supporting stand 16 through a drive shaft 14. The drive shaft 14 is connected to a motor 20 via a connecting member 17. A doctor blade 12 made of a metal such as aluminum is floatingly supported by an insulating support member 19 in such a fashion as to be directed toward the surface of the cylindrical sleeve 11 with a slight gap provided between the blade 12 and the sleeve 11. The electroconductive cylindrical sleeve 11 and the drive shaft 14 are electroconductive. When a voltage is applied to a carrier (not shown) on the electroconductive sleeve 11 by a variable direct-current source 15 through the doctor blade 12, the electric current passes through the electroconductive sleeve 11 and an electroconductive contact member 18 which is in contact with the electroconductive sleeve 11. The electric current is measured by an ammeter 21 through the contact member 18.

In the present invention, the electric current was measured with the applied voltage changed in the range from 0 to 300 V. The values obtained from the above measurement were plotted in a graph, with the applied voltage as ordinate and the electric current as abscissa. The dynamic resistance is expressed by the gradient of a curve obtained in the graph.

In the present invention, the conditions for measuring the dynamic resistance were as follows:

| | | |
|---|---|---|
| Cylindrical electroconductive sleeve: | Diameter | 5.5 mm |
| | Length | 10.5 mm |
| Gap between the sleeve and the doctor blade: | | 1.0 mm |
| Applied voltage by the direct-current source: | | 100 V, 200 V and 300 V |
| Revolutions of the sleeve: | | 200 rpm |
| Amount of the carrier: | | 200 g |

The dynamic resistance of the carrier is one of the important characteristic values which indicate the development performance of the developer. The dynamic resistance of the carrier indicates the current flow mobility when the developer is in a dynamic state in a development unit. It is conventionally known that the toner particles deposited on carrier particles are transported onto the photoconductor for development of the latent electrostatic images formed thereon at a rate proportional to the potential difference between the photoconductor and the development sleeve. In the case of a two-component type developer, the carrier particles and the toner particles form a magnetic brush between the photoconductor and the development sleeve. Therefore, the development performance of the two-component type developer is critically dependent on the electroconductivity of the above magnetic brush.

Namely, when the dynamic resistance of the carrier in the developer is small, that is, the electroconductivity of the magnetic brush is high, the development performance is improved in the same manner as in the case where the distance between the development sleeve and the photoconductor is reduced. As previously mentioned, when the specific triboelectric charge quantity of the toner particles is high, the development performance generally decreases. However, the decrease in the development performance can be compensated for by lowering the dynamic resistance of the carrier particles. More specifically, when the specific charge quantity of the toner particles is 25 $\mu C/g$ or more, it is possible to maintain the development performance at a satisfactory level if the dynamic resistance of the carrier particles is $1.0\times10^8\ \Omega$ or less.

In the present invention, any of the conventional toners which comprise as the main components a binder resin and a coloring agent can be employed. Examples of the above-mentioned binder resin are styrene monomers and substituted products thereof such as polystyrene, poly p-chlorostyrene and polyvinyl toluene; styrene copolymers such as styrene - p-chlorostyrene copolymer, styrene - propylene copolymer, styrene - vinyltoluene copolymer, styrene - vinylnaphthalene copolymer, styrene - methyl acrylate copolymer, styrene - ethyl acrylate copolymer, styrene - butyl acrylate copolymer, styrene - octyl acrylate copolymer, styrene - methyl methacrylate copolymer, styrene - ethyl methacrylate copolymer, styrene - butyl methacrylate copolymer, styrene - methyl $\alpha$-chloromethacrylate copolymer, styrene - acrylonitrile copolymer, styrene - vinylmethyl ether copolymer, styrene - vinylethyl ether copolymer, styrene - vinylmethylketone copolymer, styrene - butadiene copolymer, styrene - isoprene copolymer, styrene - acrylonitrile - indene copolymer, styrene - maleic acid copolymer and styrene - maleic acid ester copolymer; and polymethyl methacrylate, polybutyl methacrylate, polyvinyl chloride, polyvinyl acetate, polyethylene, polypropylene, polyester, polyurethane, polyamide, epoxy resin, polyvinyl butyral, polyacrylic acid resin, rosin, modified rosin, terpene resin, phenolic resin, aliphatic or alicyclic hydrocarbon resin, aromatic petroleum resin, chlorinated paraffin wax and paraffin wax. These resins can be used alone or in combination.

Examples of the coloring agent for use in the toner are carbon black, lamp black, black iron oxide, ultramarine, nigrosine dye, Anillne Blue, Phthalocyanine Blue, Phthalocyanine Green, Hansa Yellow G, Rhodamine 6C Lake, Calconyl Blue, Chrome Yellow, Ultramarine Yellow, Methylene Blue, Du Pont Oil Red, Quinoline Yellow, Methylene Blue Chloride, Malachite Green Oxalate, Quinacridone, Benzidine Yellow, Rose Bengale, triarylmethane dyes, monoazo dyes and pigments, and disazo dyes and pigments. These coloring agents can be used alone or in combination.

It is preferable that the amount of the coloring agent be in the range of about 1 to 20 parts by weight of 100 parts by weight of the binder resin in order to produce visible toner images with high image density.

To impart more effective chargeability to the toner, the toner for use in the present invention may further comprise a charge controlling agent such as a dye and a pigment. Specific examples of the above charge controlling agent are metal complex salts of monoazo dyes, nitrohumic acid and salts thereof, metal complex amino compounds of salicylic acid, naphthoic acid or dicarboxylic acid, including Co, Cr or Fe, quaternary ammonium compounds, and organic dyes.

Moreover, the toner of the present invention may further comprise a fluidity-imparting agent such as colloidal silica; an abrasive such as titanium oxide, aluminum oxide and silicon carbide; and a lubricant such as metallic salts of fatty acids.

The toner for use in the present invention can be prepared by any of the conventional methods. For instance, the above-mentioned components are blended in accordance with the predetermined formulation, and powdered to thoroughly mix all the components. The thus obtained mixture is further pulverized, so that the desired toner can be prepared. According to another conventional method, a mixture of a binder resin, a coloring agent and a solvent is placed in a ball mill. The toner composition thus obtained is subjected to spray drying to prepare toner particles.

In the two-component dry type developer according to the present invention, it is preferable that the concentration of the toner particles in the developer be in the range of 1 to 7 wt. %.

Other features of this invention will become apparent in the course of the following description of exemplary embodiments, which are given for illustration of the invention and are not intended to be limiting thereof.

EXAMPLE 1

Preparation of Carrier 120 g of a styrene - methyl methacrylate copolymer was dissolved in 3000 g of toluene. To the above prepared solution, 50 g of acetylene black was added. This mixture was stirred in a homomixer for 10 minutes to obtain a coating liquid. The thus obtained coating liquid was applied to 5000 g of iron powder with an average particle diameter of 70 μm by spray-coating, followed by drying. Thus, carrier particles for use in the present invention were prepared. The dynamic resistance of the thus obtained carrier was $1.0\times10^8$ Ω.

Preparation of Toner

The following components were mixed in a mixer and kneaded with application of heat at a temperature ranging from 130° to 140° C. for about 30 minutes in a roll mill. The thus kneaded mixture was cooled to room temperature, pulverized and classified, so that a toner with an average particle diameter of 9 μm was obtained.

| | Parts by Weight |
|---|---|
| Styrene/n-butyl methacrylate copolymer, "Himer SBM73" (Trademark) made by Sanyo Chemical Industries, Ltd. | 100 |
| Nigrosine dye, "Spirit Black SB" (Trademark) made by Orient Chemical Industries, Ltd. | 1 |
| Carbon black | 10 |

Three parts by weight of the thus obtained toner and 97 parts by weight of the above-prepared carrier were mixed in a ball mill, whereby a two-component type developer No. 1 according to the present invention was obtained.

The specific triboelectric charge quantity (Q/M) of the toner in the above developer No. 1, measured by the blow-off method, was 31 μC/g.

The thus obtained developer No. 1 was subjected to an image formation test using a commercially available copying machine, "FT-4820" (Trademark) made by Ricoh Company Ltd. According to the measurement by a Mcbeth densitometer, the image density of the obtained images was 1.25.

EXAMPLE 2

Preparation of Carrier

A mixture of 3000 g of a commercially available silicone resin, "SR-2400" (Trademark), made by Toray Silicone Co., Ltd., with a solid component content of 20%, and 3000 g of toluene was stirred in a homomixer for 10 minutes. To the above mixture, 150 g of electroconductive particles of acetylene black and 480 g of magnetite were added, followed by further stirring for 10 minutes. The toluene was distilled away from the mixture by application of heat, so that a magnetic-material-dispersed solid was obtained.

This solid was calcined at 350° C. in an electric furnace and cooled to room temperature. Thereafter, the solid was ground by a jet grinder and classified, whereby finely-divided silicone-containing carrier particles having an average particle diameter of 65 μm were prepared, containing the above-mentioned magnetic material and electroconductive particles in a dispersed state. The dynamic resistance of the carrier particles was $0.8\times10^8$ Ω.

97 parts by weight of the above-prepared carrier particles and 3 parts by weight of the same toner as used in Example 1 were mixed in a ball mill, whereby a two-component type developer No. 2 according to the present invention was obtained.

The specific triboelectric charge quantity (Q/M) of the toner in the above developer No. 2, measured by the blow-off method, was 36 μC/g.

The thus obtained developer No. 2 was subjected to the same image formation test as in Example 1. As a result, the image density of the obtained images was 1.23.

EXAMPLES 3 TO 9 AND COMPARATIVE EXAMPLES 1 TO 6

The carrier particles with the average particle diameter and dynamic resistance as set forth in Table 1 were prepared in the same manner as in Example 2 by controlling the amount of acetylene black and the calcination temperature.

The respective toner particles with the average particle diameter as set forth in Table 1 were prepared in the same manner as in Example 2 by controlling the classification.

The carrier particles and toner particles thus obtained were mixed in the same manner as in Example 2, so that two-component type developers No. 3 to No. 9 according to the present invention and comparative two-component type developers No. 1 to No. 6 were obtained.

Each of the above-prepared two-component type developers was subjected to the same image formation test as in Example 1. The results are shown in Table 1.

TABLE 1

| | Scattering of Toner | Average Dia. of Carrier Particle (μm) | Average Dia. of Toner Particle (μm) | Carrier Dynamic Resistance (Ω) | Av. Dia. Ratio (Toner/Carrier) | Specific Triboelectric Charge qt. (μC/g) | Image Density |
|---|---|---|---|---|---|---|---|
| Ex. 1 | Nil | 70 | 9 | $1.0\times10^8$ | 0.128 | 31 | 1.25 |
| Ex. 2 | Nil | 65 | 9 | $0.8\times10^8$ | 0.138 | 36 | 1.23 |
| Ex. 3 | Nil | 65 | 7 | $0.7\times10^8$ | 0.107 | 41 | 1.21 |
| Ex. 4 | Nil | 50 | 8 | $1.0\times10^8$ | 0.160 | 37 | 1.25 |
| Ex. 5 | Nil | 60 | 8 | $0.5\times10^8$ | 0.130 | 42 | 1.26 |
| Ex. 6 | Nil | 70 | 14 | $1.0\times10^8$ | 0.200 | 25 | 1.20 |
| Ex. 7 | Nil | 65 | 7 | $1.0\times10^8$ | 0.107 | 26 | 1.20 |
| Ex. 8 | Nil | 80 | 12 | $0.8\times10^8$ | 0.150 | 30 | 1.22 |
| Ex. 9 | Nil | 50 | 8 | $0.5\times10^8$ | 0.160 | 31 | 1.20 |
| Comp. | Nil | 65 | 12 | $2.0\times10^8$ | 0.180 | 37 | 0.60 |

TABLE 1-continued

| | Scattering of Toner | Average Dia. of Carrier Particle (μm) | Average Dia. of Toner Particle (μm) | Carrier Dynamic Resistance (Ω) | Av. Dia. Ratio (Toner/Carrier) | Specific Triboelectric Charge qt. (μC/g) | Image Density |
|---|---|---|---|---|---|---|---|
| Ex. 1 | | | | | | | |
| Comp. Ex. 2 | Nil | 90 | 12 | $1.5 \times 10^8$ | 0.130 | 36 | 0.62 |
| Comp. Ex. 3 | Nil | 80 | 12 | $1.0 \times 10^8$ | 0.150 | 34 | 0.67 |
| Comp. Ex. 4 | Nil | 50 | 12 | $1.0 \times 10^8$ | 0.240 | 35 | 0.80 |
| Comp. Ex. 5 | Observed | 70 | 14 | $1.0 \times 10^8$ | 0.200 | 20 | 1.23 |
| Comp. Ex. 6 | Nil | 70 | 14 | $2.0 \times 10^8$ | 0.200 | 25 | 0.93 |

As can be seen from the test results as shown in Table 1, when the specific triboelectric charge quantity of the toner is 25 μC/g or more, the image density reaches as high as 1.20 or more on condition that the carrier dynamic resistance is $1.0 \times 10^8$ or less and the ratio of the average toner particle diameter to the average carrier particle diameter was 1/5 or less.

The two-component type developer according to the present invention has the following advantages:

(1) The toner particles in the present invention do not scatter while in use since the specific triboelectric charge quantity of the toner is 25 μC/g or more.

(2) Images with high image density can be obtained even when the specific charge quantity of the developer is large. This is because the average particle diameter of the carrier particle is 70 μm or less and the dynamic resistance of the carrier is as low as $1.0 \times 10^8$ Ω or less.

(3) In the case of a carrier particle comprising a resin layer, the resistance of the carrier can be easily decreased by controlling the amount of the finely-divided electroconductive particles dispersed in the resin layer.

(4) In the case of a carrier particle coated with a resin layer, the durability of the carrier is increased.

(5) In the case of a binder-type carrier prepared by dispersing finely-divided electroconductive particles in a magnetic-powder-dispersed binder resin, the particle diameter, magnetic characteristics and dynamic resistance of the carrier can easily be controlled.

What is claimed is:

1. A two-component dry type developer for developing latent electrostatic images comprising:

toner particles with an average particle diameter of 14 μm or less; and carrier particles with an average particle diameter of 70 μm or less, with the ratio of the average particle diameter of said toner particles to the average particle diameter of said carrier particles being 1/5 or less, and with a dynamic resistance of $1.0 \times 10^8$ Ω or less; the specific triboelectric charge quantity generated between said toner particles and said carrier particles per unit weight of said toner particles being 25 μC/g or more.

2. The two-component dry type developer as claimed in claim 1, wherein said carrier particles comprises a magnetic core material coated with a resin layer in which finely-divided electroconductive particles are dispersed.

3. The two-component dry type developer as claimed in claim 2, wherein said finely-divided electroconductive particles have a particle diameter of 5 μm or less.

4. The two-component dry type developer as claimed in claim 2, wherein said magnetic core material comprises a material selected from the group consisting of alloys and compounds including ferrite, magnetite, cobalt or nickel.

5. The two-component dry type developer as claimed in claim 2, wherein said magnetic core material comprises a material selected from the group consisting of a manganese-copper-aluminum alloy and a manganese-copper-tin alloy.

6. The two-component dry type developer as claimed in claim 2, wherein said magnetic core material comprises chromium dioxide.

7. The two-component dry type developer as claimed in claim 2, wherein said resin layer comprises a resin selected from the group consisting of acrylic resin, methacrylic resin, polyester resin, polystyrene, polyethylene, polypropylene, polyvinylidene fluoride, polyvinylidene chloride, polyvinyl chloride, ethylene - vinyl acetate copolymer, styrene - acrylate copolymer, styrene - methacrylate copolymer, styrene - butadiene copolymer, styrene - vinylidene chloride copolymer, styrene - acrylonitrile copolymer, epoxy resin, modified rosin, polyethylene wax, polycarbonate resin and silicone resin.

8. The two-component dry type developer as claimed in claim 1, wherein said carrier particles comprises a magnetic material, finely-divided electroconductive particles, and a binder resin.

9. The two-component dry type developer as claimed in claim 3, wherein said finely-divided electroconductive particles have a particle diameter of 5 μm or less.

10. The two-component dry type developer as claimed in claim 3, wherein said magnetic material comprises a material selected from the group consisting of alloys and compounds including ferrite, magnetite, cobalt or nickel.

11. The two-component dry type developer as claimed in claim 3, wherein said magnetic material comprises a material selected from the group consisting of a manganese-copper-aluminum alloy and a manganese-copper-tin alloy.

12. The two-component dry type developer as claimed in claim 3, wherein said magnetic material comprises chromium dioxide.

13. The two-component dry type developer as claimed in claim 3, wherein said resin is selected from the group consisting of acrylic resin, methacrylic resin, polyester resin, polystyrene, polyethylene, polypropylene, polyvinylidene fluoride, polyvinylidene chloride, polyvinyl chloride, ethylene - vinyl acetate copolymer, styrene - acrylate copolymer, styrene - methacrylate copolymer, styrene - butadiene copolymer, styrene - vinylidene chloride copolymer, styrene - acrylonitrile copolymer, epoxy resin, modified rosin, polyethylene wax, polycarbonate resin and silicone resin.

14. The two-component dry type developer as claimed in claim 1, wherein said toner particles comprise a binder resin and a coloring agent.

15. The two-component dry type developer as claimed in claim 14, wherein said binder resin is selected from the group consisting of polystyrene, poly p-chlorostyrene, polyvinyl toluene, styrene - p-chlorostyrene copolymer, styrene - propylene copolymer, styrene - vinyltoluene copolymer, styrene - vinylnaphthalene copolymer, styrene - methyl acrylate copolymer, styrene - ethyl acrylate copolymer, styrene - butyl acrylate copolymer, styrene - octyl acrylate copolymer, styrene - methyl methacrylate copolymer, styrene - ethyl methacrylate copolymer, styrene - butyl methacrylate copolymer, styrene - methyl α-chloromethacrylate copolymer, styrene - acrylonitrile copolymer, styrene - vinylmethyl ether copolymer, styrene - vinylethyl ether copolymer, styrene - vinylmethylketone copolymer, styrene - butadiene copolymer, styrene - isoprene copolymer, styrene - acrylonitrile - indene copolymer, styrene - maleic acid copolymer, styrene - maleic acid ester copolymer, polymethyl methacrylate, polybutyl methacrylate, polyvinyl chloride, polyvinyl acetate, polyethylene, polypropylene, polyester, polyurethane, polyamide, epoxy resin, polyvinyl butyral, polyacrylic acid resin, rosin, modified rosin, terpene resin, phenolic resin, aliphatic hydrocarbon resin, alicyclic hydrocarbon resin, aromatic petroleum resin, chlorinated paraffin wax and paraffin wax.

16. The two-component dry type developer as claimed in claim 14, wherein said coloring agent is selected from the group consisting of carbon black, lamp black, black iron oxide, ultramarine, nigrosine dye, Aniline Blue, Phthalocyanine Blue, Phthalocyanine Green, Hansa Yellow G, Rhodamine 6C Lake, Calconyl Blue, Chrome Yellow, Ultramarine Yellow, Methylene Blue, Du Pont Oil Red, Quinoline Yellow, Methylene Blue Chloride, Malachite Green Oxalate, Quinacridone, Benzidine Yellow, Rose Bengale, triarylmethane dyes, monoazo dyes and pigments, and disazo dyes and pigments.

17. The two-component dry type developer as claimed in claim 14, wherein the amount of said coloring agent is in the range of about 1 to 20 parts by weight of 100 parts by weight of said binder resin.

18. The two-component dry type developer as claimed in claim 15, wherein said toner particle further comprises a charge controlling agent.

19. The two-component dry type developer as claimed in claim 14, wherein said toner particle further comprises a fluidity-imparting agent.

20. The two-component dry type developer as claimed in claim 14, wherein said toner particle further comprises an abrasive selected from the group consisting of titanium oxide, aluminum oxide and silicon carbide.

21. The two-component dry type developer as claimed in claim 14, wherein said toner particle further comprises a lubricant.

22. A two-component dry type developer for developing latent electrostatic images comprising:

toner particles with an average particle diameter of 14 μm or less; and carrier particles with an average particle diameter of 70 μm or less, said carrier particles comprising particles of an inorganic material and an organic resin, with the ratio of the average particle diameter of said toner particles to the average particle diameter of said carrier particles being 1/5 or less, and with a dynamic resistance of $1.0\times10^{8}\,\Omega$ or less; the specific triboelectric charge quantity generated between said toner particles and said carrier particles per unit weight of said toner particles being 25 μC/g or more.

* * * * *